United States Patent [19]

Gillard et al.

[11] 4,441,948

[45] Apr. 10, 1984

[54] METHOD AND APPARATUS FOR CONSTRUCTING MULTIPLE LAYER CORRUGATED BOARD CONTAINERS

[75] Inventors: David F. Gillard, Surrey; Jack T. Yelf, West Vancouver, both of Canada

[73] Assignee: MacMillan Bloedel Limited, Vancouver, Canada

[21] Appl. No.: 397,990

[22] Filed: Jul. 14, 1982

[30] Foreign Application Priority Data

Oct. 28, 1981 [GB] United Kingdom ..... 8132505

[51] Int. Cl.[3] ..... B31F 1/22

[52] U.S. Cl. ..... 156/189; 156/194; 156/207; 156/446; 493/295; 493/303

[58] Field of Search ..... 156/446, 184, 189, 195, 156/207; 493/295, 303

[56] References Cited

U.S. PATENT DOCUMENTS

| | | | |
|---|---|---|---|
| 1,090,593 | 3/1914 | Bolger | 156/207 X |
| 1,466,034 | 8/1923 | Snyder | 493/295 X |
| 2,153,652 | 4/1939 | Stock | 493/295 X |
| 3,300,355 | 1/1967 | Adams | 156/189 |
| 3,300,356 | 1/1967 | Warnken | 156/189 |
| 3,380,873 | 4/1968 | Angst | 156/446 |
| 3,665,819 | 5/1972 | Gardner | 156/446 X |
| 3,732,790 | 5/1973 | Miyake et al. | 156/207 X |
| 3,919,925 | 11/1975 | Hayama | 493/295 |
| 3,926,098 | 12/1975 | Smith | 493/295 X |
| 4,168,808 | 9/1979 | Santi et al. | 156/446 X |

*Primary Examiner*—David A. Simmons

*Attorney, Agent, or Firm*—Banner, Birch, McKie & Beckett

[57] ABSTRACT

A method and an apparatus is disclosed for forming a multi-layered container of compressible sheet layers, such as corrugated board. The containers are formed in a single operation and avoids the known techniques of folding the layers before laminating in multistep methods. Furthermore, the container may be folded without the layers separating. The method of forming a multi-layered container having a plurality of flat sides with corners between adjacent sides comprises winding compressible sheet layers on a forming mandrel. In the process, one edge of a layer is attached adjacent to a corner of a mandrel, a shoe plate applies pressure to the layer against the mandrel as it rotates to maintain a substantially constant pressure and tension on the layer. An additional momentary force is applied to the shoe plate as each corner of the mandrel passes over the shoe plate such that the layer at each corner is compressed.

13 Claims, 4 Drawing Figures

FIG. 1
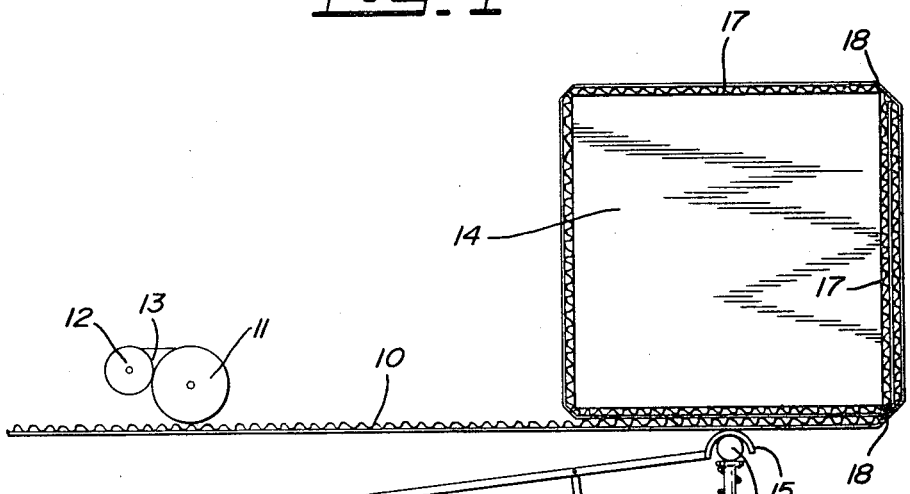
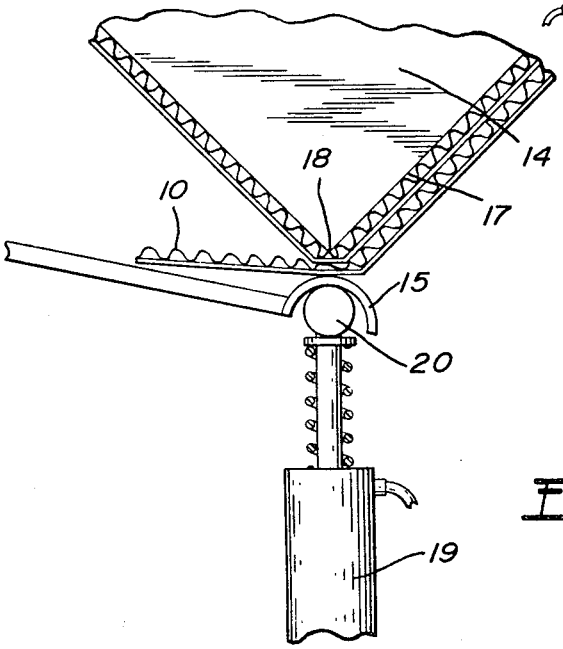
FIG. 2

METHOD AND APPARATUS FOR CONSTRUCTING MULTIPLE LAYER CORRUGATED BOARD CONTAINERS

This invention relates to multi-layered flat walled bulk storage bins or containers made from a collapsible or compressible sheet material such as corrugated board. More particularly, the invention relates to a method and apparatus for winding single face corrugated board in multiple layers to form a storage container with substantially flat walls.

Corrugated board is generally made by gluing a corrugated sheet medium to a flat sheet liner. Any paper, containerboard or linerboard may be used as medium or liner. The gluing occurs at the tips of the corrugations and in this way the corrugated sheet is held firm to the flat sheet and prevented from stretching or flattening. Single face corrugated board has one flat sheet and one corrugated sheet. Double face corrugated board is a corrugated sheet sandwiched between two flat sheets. This material is also referred to as single wall corrugated board. Double wall corrugated board is a five layer composite with sheets arranged alternatively as flat-corrugated-flat-corrugated-flat. Boxes may be made from single wall or double wall corrugated board depending on the strength requirements.

Large corrugated boxes used for bulk storage bins or containers require strong reinforcement and are made from multiple layers of corrugated board. These bins are conventionally made by combining two or more layers of double wall corrugated board. The process of construction involves making the board, scoring the successive layers separately, gluing, folding, and laminating the components together to form the final bin. This sequence of manufacture is time-consuming and labor intensive.

The present invention is concerned with a method whereby the walls of the storage bin are constructed in a single operation. A mandrel is prepared having an outside surface which is the desired interior size and shape of the bin or container. Single face corrugated board is then wound around the mandrel for a sufficient number of layers to give the required strength to the container. Before each layer of corrugated board is wound onto the mandrel, glue is applied to the tips of the corrugations on the corrugated side of the layer and then a pressure shoe plate presses against the corrugated board layer to provide a constant pressure on the layer and ensure that it adheres to the previous layer. In some containers a flat sheet may be passed around the mandrel before commencing winding the first corrugated board layer. As the mandrel rotates and a corner of the mandrel passes over the pressure shoe plate a momentary force, additional to the constant pressure, is applied to the corner. This force is of sufficient magnitude to collapse the corrugations at the corner. The constant pressure from the shoe plate holds the layer so as it is wound onto the mandrel, a tension is provided in the layer to ensure that this corner compression is maintained as the mandrel rotates. The tension in the layer also helps to provide good corrugation tip contact along the face of the mandrel to ensure a proper glue joint occurs between the layers. The momentary force compresses the layers substantially so that when the finished container is removed from the mandrel it may be folded at the corners into the flattened or "knock-down" configuration without separating layers or causing additional crinkles to occur in layers, which can otherwise occur at the corners.

The present invention provides in a method of forming a multi-layered container having a plurality of substantially flat sides with corners between adjacent sides, wherein compressible sheet layers such as corrugated board layers are wound on a forming mandrel, the improvement comprising the steps of:

attaching one edge of a corrugated board layer adjacent to a corner of the mandrel, pressing a pressure shoe plate across the width of the layer against the mandrel, rotating the mandrel to wind the layer on the mandrel ensuring that the plate has sufficient movement to be in contact with the layer on the mandrel as it rotates to keep a substantially constant pressure and tension on the layer, and applying an additional momentary force to the shoe plate as each corner of the mandrel passes over the shoe plate, such that the layer at each corner is compressed.

In one embodiment the corrugated board layer is a single face corrugated sheet, and included is a step of applying glue to tips of corrugations on the single face corrugated sheet.

The present invention also provides an apparatus for forming a multi-layered container of corrugated board having a plurality of substantially flat sides with corners between adjacent sides, comprising a forming mandrel having a plurality of substantially flat sides with corners between adjacent sides of the mandrel having means to grip an edge of a corrugated board layer, rotating means to rotate the mandrel and wind the layer around the mandrel, pressure shoe plate located across the width of the mandrel and having movement in a predetermined path, pressure means to push the plate in a predetermined path against the mandrel at a substantially constant pressure so that the layer is squeezed between the plate and the mandrel during rotation of the mandrel, and momentary high pressure means to provide an additional force on the plate to compress the layer at each corner of the mandrel.

In drawings which illustrate the embodiments of the invention,

FIG. 1 is a side elevational view showing one embodiment of a rotating mandrel and pressure shoe plate of the present invention.

FIG. 2 is a partial side elevational view showing the pressure shoe plate and the additional momentary high pressure device crushing the corrugated board layers at the corner of a mandrel.

FIG. 3 is a partial side view showing one corner of a three layer container in the flattened configuration.

Figure 4:
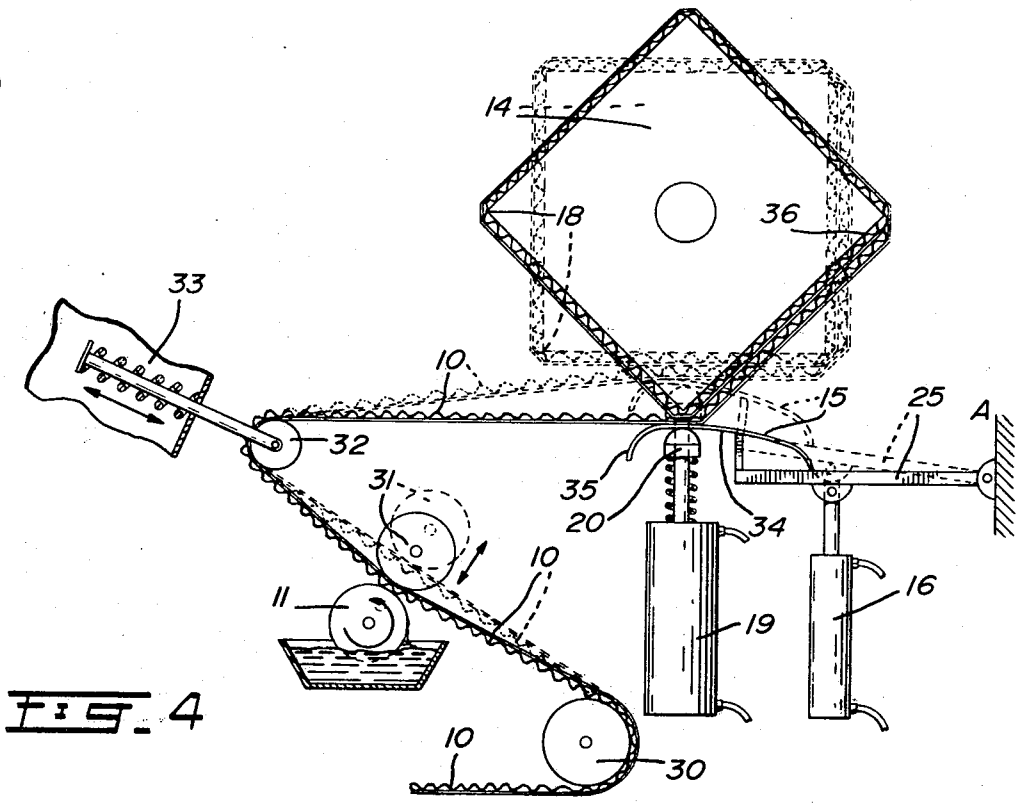
FIG. 4 is a side elevational view showing another embodiment of the present invention.
Figure 5:
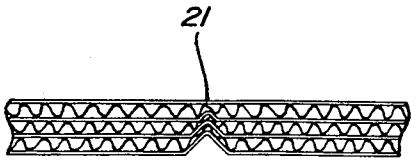

Referring now to the drawings, a single face corrugated board 10 passes under a glue applicator roll 11 which rotates against a doctor roll 12, the trough formed between roll 11 and 12 providing a reservoir for the glue 13. The glue roll 11 places glue only on the tips of the corrugations. The corrugated board layer 10 then commences to be wrapped around a rotating mandrel 14 and a pressure shoe plate 15, pivoted at point A, is urged towards the mandrel 14 by a first air cylinder 16, pressing the layer 10 onto the preceding layer on the mandrel 14 with a substantially continuous pressure. Before the first corrugated board layer is wrapped around the mandrel 14, a flat sheet such as linerboard may be placed around the mandrel. If it is satisfactory to have a corrugated surface on the inside of the container being formed, then no flat sheet is necessary and no glue is used for the first corrugated board layer 10 wrapped around the mandrel.

The mandrel 14 has substantially flat surfaces 17 with corners 18 between adjacent sides. As each corner 18 passes over the pressure shoe plate 15, as illustrated in FIG. 2, a second pair of air cylinders 19 are activated which exert an additional momentary pressure towards the corner 18 through a high pressure contact member 20 which conforms approximately to the shape of the pressure shoe plate 15, thus flattening each layer 10 at the corner. The contact member 20 is supported on springs so that the contact member touches the underside of the shoe plate 15 just before the air cylinders 19 apply an additional momentary pressure at the corners 18. The first air cylinder 16 ensures that the pressure shoe plate 15 always exerts an even pressure on the layer as it passes over the flat surfaces 17 of the mandrel 14. The pressure of the shoe plate 15 ensures gluing occurring between the layers, and also creates drag on the layer to provide a tension in the layer as it is wound onto the mandrel. This tension ensures that each corner compression is maintained as the mandrel rotates. A momentary high pressure is applied to each layer at every corner of the mandrel by the contact member 20 so that every corner of every layer is individually crushed.

After completion of the winding step, the container is removed from the mandrel 14. The container may then be flattened. Each of the crushed corners form a hinge 21, as illustrated in FIG. 3, allowing a bend to occur at the hinge so that the separate layers of the containers which are glued together do not separate or crinkle at the corners when the container is flattened for storage purposes.

To complete the container, corrugated board caps may be attached to the bottom and top side walls of the container by gluing, stapling or other suitable means.

Another embodiment is shown in FIG. 4 wherein a single face corrugated sheet 10 passes over a fixed roll 30, followed by a glue applicator roll 11. A backing roll 31 is provided to push the sheet against the glue applicator roll 11 so glue is applied to tips of the corrugations on the sheet. A constant tension roll 32 connected to a spring loaded constant tension device 33 maintains constant tension on the sheet 10 during the winding. The constant tension roll 32 maintains the sheet 10 in a line such that when the backing roll 31 is released, the sheet 10 does not contact the glue applicator roll 11, and a first layer can be wrapped around the mandrel without having glue applied.

The constant tensioning roll 32 allows the sheet 10 to advance at an even speed while the winding of the mandrel, although rotating at an even speed of revolution, need not have an even linear sheet speed. This is particularly true when rectangular containers are formed. The pressure shoe plate 15 is contoured so that a vertical upward pressure on the plate 15 does not cause undue torque to rotate the mandrel 14.

The shape of the pressure shoe plate 15 provides a substantially flat or shallow curved top surface 34 and a more sharply curved lip 35 at the front facing the incoming sheet 10, pins 36 are positioned at one corner of the mandrel 14 across the width of the mandrel to hold one edge of the first corrugated sheet layer 10. The pressure shoe plate 15 is supported by a lever arm pivoting at point A. One air cylinder 16 keeps a constant pressure acting as a spring on the plate 15 so it is pushed against the mandrel. A high pressure contact member 20 having a top surface contoured to fit the lower surface of the plate 15 is powered by two air cylinders 19, one on each end of the contact member 20 across the width of the mandrel. A cam system (not shown) attached to the mandrel activates an air valve (not shown) to supply air to cylinders 19 so that the contact member 20 imparts an additional momentary force to plate 15 at the exact moment that a corner 18 of the mandrel 14 is touching the plate 15.

In one embodiment, the cylinders 19 have an air reservoir supply and an air valve opens the reservoir supply to the cylinders 19. In this embodiment only a small air pressure supply line is required.

It has been found that a pressure of between about 3 and 6 pli between the pressure shoe plate 15 and the mandrel is a sufficient constant pressure to ensure gluing occurs and provide sufficient tension in a single face corrugated sheet. A crushing pressure in the range of 20 to 40 pli provides a sufficient momentary force to crush the corrugated sheet.

Whereas the pressure cylinders 15 and 19 are described as air cylinders it will be obvious to those skilled in the art that hydraulic cylinders may also be used to apply the same force. Furthermore, any other pressurizing means may be used provided that the response is sufficiently rapid and precise that the additional force exerted by the contact member 20 occurs only at the corners of the bin being formed.

Whereas the glue applicator is shown to be a roller in the embodiment described herein it will be obvious to those skilled in the art that any glue applicator, capable of applying glue only to the tips of the corrugations, may be used.

A separate supply system may be supplied at the other side of the mandrel to lay a flat sheet around the mandrel before the first layer of corrugated board is wound on. The flat sheet does not have to pass under the pressure shoe plate 15 because there is no need to crush the sheet.

The embodiments of the invention in which an exclusive property or privilege is claimed are defined as follows:

1. In a method of forming a multi-layered container having a plurality of substantially flat sides with corners between adjacent sides, wherein compressible sheet layers are wound on a forming mandrel, the improvement comprising the steps of:

attaching one edge of a compressible sheet layer adjacent a corner of the mandrel, pressing a pressure shoe plate across the width of the layer against the mandrel, rotating the mandrel to wind the layer on the mandrel ensuring that the plate has sufficient movement to be in contact with the layer on the mandrel as it rotates to keep a substantially constant pressure on the mandrel, said substantially constant pressure being insufficient to compress the layer, and applying an additional momentary force to the shoe plate as each corner of the mandrel passes over the shoe plate such that the layer at each corner is compressed.

2. The method according to claim 1 wherein the compressible sheet layer is a single face corrugated sheet.

3. The method according to claim 2 including the step of applying glue to tips of corrugations on the single face corrugated sheet before winding onto the mandrel.

4. The method according to claim 1 or claim 2 wherein a plain sheet is placed around the mandrel before winding of the compressible sheet.

5. The method according to claim 1 wherein a coating of glue is applied to the layer moving at a substantially constant speed, and the layer is tensioned by a constant tension roll between the application of glue and winding on the mandrel to take into account the varying speed the layer winds around the mandrel.

6. An apparatus for forming a multi-layered container of corrugated board having a plurality of substantially flat sides with corners between adjacent sides comprising:

a forming mandrel having a plurality of substantially flat sides with corners between adjacent sides, the mandrel having means to grip an edge of a corrugated board layer, rotating means to rotate the mandrel and wind the layer around the mandrel, pressure shoe plate located across the width of the mandrel and having movement in a predetermined path, pressure means to push the plate in the predetermined path against the mandrel at a substantially constant pressure so that the layer is squeezed between the plate and the mandrel during rotation of the mandrel, said substantially constant pressure being insufficient to compress the layer, and momentary high pressure means to provide an additional force on the plate to compress the layer at each corner of the mandrel.

7. The apparatus according to claim 5 wherein the momentary high pressure means is triggered by a cam system or electronic control to cause the additional force to act precisely at each corner of the mandrel.

8. The apparatus according to claim 5 including a glue coating means positioned before the mandrel such that the layer has a coating of glue applied to a surface of the sheet adjacent to the mandrel.

9. The apparatus according to claim 5 wherein the pressure shoe plate has a substantially flat top surface with a curved lip extending downwards from the front of the plate.

10. The method according to claim 1 wherein said additional momentary force is applied to the shoe plate using an air cylinder.

11. The method according to claim 1 wherein said additional momentary force is applied to the shoe plate using a hydraulically actuated cylinder.

12. The apparatus according to claim 6 wherein said momentary high pressure means comprises an air cylinder.

13. The apparatus according to claim 6 wherein said momentary high pressure means comprises a hydraulically actuated cylinder.

* * * * *

UNITED STATES PATENT AND TRADEMARK OFFICE

CERTIFICATE OF CORRECTION

PATENT NO. : 4,441,948

DATED : April 10, 1984

INVENTOR(S) : David F. Gillard and Jack T. Yelf

It is certified that error appears in the above—identified patent and that said Letters Patent is hereby corrected as shown below:

In claim 7, line 1, delete "5" and insert instead -- 6 --.

In claim 8, line 1, delete "5" and insert instead -- 6 --.

In claim 9, line 1, delete "5" and insert instead -- 6 --.

Signed and Sealed this

*Third* Day of *September 1985*

[SEAL]

*Attest:*

DONALD J. QUIGG

*Attesting Officer* *Acting Commissioner of Patents and Trademarks - Designate*